US005103605A

United States Patent [19]

Sul

[11] Patent Number: 5,103,605

[45] Date of Patent: Apr. 14, 1992

[54] EARTHQUAKE RESISTANT BUILDING SUPPORT SYSTEM

[76] Inventor: Tae H. Sul, 12232 Central St., Lakewood, Calif. 90715

[21] Appl. No.: 692,665

[22] Filed: Apr. 29, 1991

[51] Int. Cl.[5] ..... E04B 1/98

[52] U.S. Cl. ..... 52/167 R

[58] Field of Search ..... 52/167 R, 573

[56] References Cited

U.S. PATENT DOCUMENTS

| | | | |
|---|---|---|---|
| 838,302 | 12/1906 | Codman | 52/167 R |
| 2,055,000 | 9/1936 | Bacigalupo | 52/167 R |
| 4,402,483 | 9/1983 | Kurabayashi | 52/167 R |
| 4,581,199 | 4/1986 | Bioret | 52/167 R |

FOREIGN PATENT DOCUMENTS

| | | | |
|---|---|---|---|
| 727825 | 4/1980 | U.S.S.R. | 52/167 R |
| 755988 | 8/1980 | U.S.S.R. | 52/167 R |

*Primary Examiner*—John E. Murtagh
*Attorney, Agent, or Firm*—Frank D. Gilliam

[57] ABSTRACT

A building support system that resists horizontal forces resulting from earthquakes. Each support or group of supports is positioned on a horizontal planar base which allows limited horizontal movement of the support relative to the base. Each support is secured to the building being supported and each base is secured to the earth or building sub-foundation. Each support includes a damping arrangement for damping horizontal oscillations of the earth. Each base includes walls limiting horizontal movement of a support across the base and energy absorbers adjacent to the walls that engage supports approaching the walls. This system will accommodate both oscillatory earth movement and horizontal longitudinal movements.

11 Claims, 2 Drawing Sheets

EARTHQUAKE RESISTANT BUILDING SUPPORT SYSTEM

BACKGROUND OF THE INVENTION

This invention relates in general to systems for use in protecting structures against damage due to earthquakes and, more specifically, structural supports for buildings to substantially isolate the buildings from earthquake forces.

Many earthquakes occur around the world each year causing great losses in lives and property damage. In areas of high earthquake risk, or "seismic zones" near geological faults, it is imperative that buildings be constructed to resist earthquake damage. When a building is supported on or embedded in the ground, an earthquake creates oscillatory movements, primarily in a horizontal plane together with vertical vibrational movements. The oscillatory movements may be greatest in a single direction, as where a land area slips in a horizontal direction relative to adjacent land on the opposite side of a fault. Thus, in addition to oscillatory movements, movement in one direction may be sufficient to displace a building in that direction.

A number of different foundation arrangements and building supports have been designed to reduce and attempt to eliminate earthquake damage. Many of these are effective with minor earth movements. Where earthquake accelerations are beyond the design limits of the supports, great damage may result. Further, in some cases the land sinks or rises, a directional force may be applied which is beyond the capability of known protective supports, which tend to react only substantially equal oscillatory forces.

A number of earthquake resistant supports use friction plates such as are described by Furchak et al in U.S. Pat. No. 4,238,137 and resilient interconnecting members such as are disclosed by Fyfe et al in U.S. Pat. No. 4,617,769 to allow a degree of oscillatory movement. Others utilize spring systems such as described by Suh in U.S. Pat. 3,761,068, sometimes in combination with friction plates such as described by Fujimoto et al in U.S. Pat. No. 4,599,834. Fluid filled bags as energy absorbers have been proposed by others, such as Aquilar in U.S. Pat. No. 4,266,379 and some have gone so far as to essentially float a building on a liquid, as described, for example, by Kalpins in U.S. Pat. No. 3,986,367. Hydraulic cylinder type earthquake energy absorbing systems have been proposed by Valencia in U.S. Pat. No. 4,587,773.

While many of these prior systems are somewhat effective against forces produced by moderate earthquakes, damage may still occur. Also, these systems tend to be complex and expensive, limiting their use in poorer countries. Many of these systems only resist oscillatory movement and are ineffective or less effective where major forces are applied in one direction, such as the case of land sinking or slipping near the building or near a fault where land on opposite sides has a relative longitudinal movement.

Thus, there is a continuing need for simple, low-cost, effective supports for buildings in earthquake prone areas to protect against all earthquake generated movements.

SUMMARY OF THE INVENTION

It is, therefore, an object of this invention to provide an earthquake resistant building support system overcoming the above noted problems. Another object of this invention is to provide a simple, low cost earthquake resistant building support system. A further object of this invention is to provide an earthquake resistant building support system which protects against both oscillatory and longitudinal forces and movements.

The above objects, and others are accomplished in accordance with this invention by a support system which basically comprises a plurality of base members, each having a smooth, planar, horizontal surface, secured to the earth or a sub-foundation below a building, and a plurality of oscillatory energy absorbing support members secured to the building, each base member having a smooth planer lower surface riding on the horizontal surface of one of the base members.

Each of the planar surfaces of the base members is surrounded by a low upstanding wall and has energy damping means along the inner surface of the walls adjacent to the horizontal surface, Each of the support members on each base member includes an energy absorbing means for absorbing horizontal oscillatory forces and/or means for allowing movement of the support member across the base horizontal surface in response to longitudinal forces. Several embodiments of the support members are disclosed, which may include means for reducing friction for at least part of the support member on the base horizontal surface.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
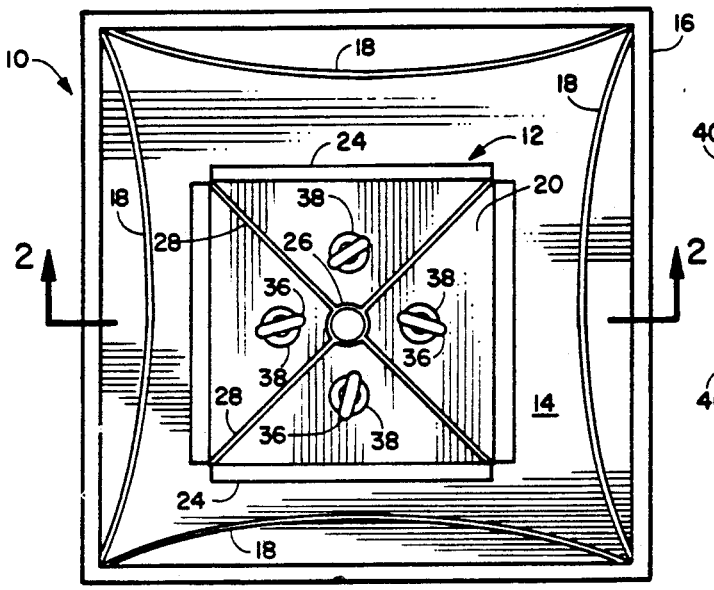
FIG. 1 is a plan view of a first embodiment of the support system of this invention.
Figure 2:
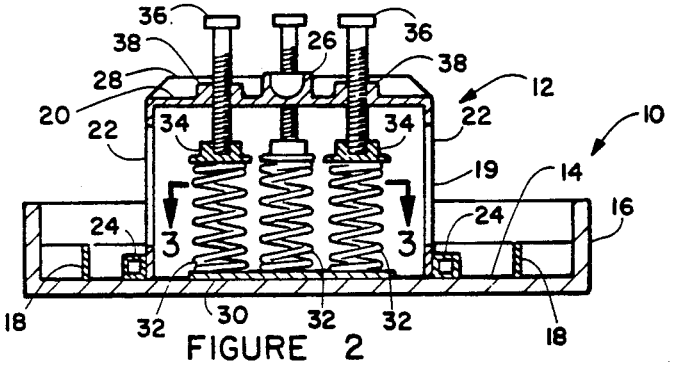
FIG. 2 is a vertical section view of the first embodiment, taken on line 2—2 in FIG. 1.

Referring now to FIGS. 1 and 2, there is seen a plan view of a first embodiment of the support system, basically including a base member 10 having located thereon a support member 12.

Base member 10 includes a horizontal planar surface 14 surrounded by low upstanding walls 16. Base member 14 may be formed from any suitable material, such as metal, concrete or the like. Generally, a smooth sturdy surface is preferred at surface 14 to resist damage if support member 12 moves across surface 14. Therefor if base member 10 is not formed from metal, it is preferred that a metal sheet be applied to surface 14. A spring band 18 is provided along each wall to absorb energy and damp oscillations if support member 12 moves toward contact with a wall 16 due to longitudinal forces during an earthquake. Band 18 may be formed from any suitable springy metal.

Support member 12 basically includes a box frame 19 like enclosure having a closed top 20, four corner posts 22, and a lower frame 24 in contact with surface 14. While the square configuration of box 19 as shown is preferred, the enclosure could have any other suitable configuration, such as cylindrical, hexagonal, etc. A socket 26 is provided at the center of top 20 to receive a downwardly extending rod or post on the building to be supported. Other building to support connection means could be used, if desired. Two reinforcing ridges 28 are preferably provided over top 20 to spread the forces imposed by the supported building across the structure.

An inner plate 30 is positioned within the bottom frame 24 in contact with surface 14. Plate 30 is independent of box 19 and is horizontally movable relative thereto. Four large compression springs 32 are secured to plate, such as by welding, and extend upwardly therefrom. A socket 34 is secured, such as by welding, to the upper end of each spring 32. Four adjustment bolts 36 are threaded through internally threaded bosses 38 secured to top sheet 20. Unthreaded ends on bolts 38 extend into sockets 34. As bolts 36 are threaded downwardly through bosses 38, the ends press sockets 34 downwardly, compressing springs 32, thus producing an upward spring force on box 19, reducing friction between bottom frame 24 and surface 14.

In the event of an earthquake, base 10 will oscillate with the earth relative to box 19 and the building being supported in order to allow the building to retain relatively stable and to damp the oscillations, box 19 will slide back and forth while plate 30 remains relatively stable.

Figure 3:
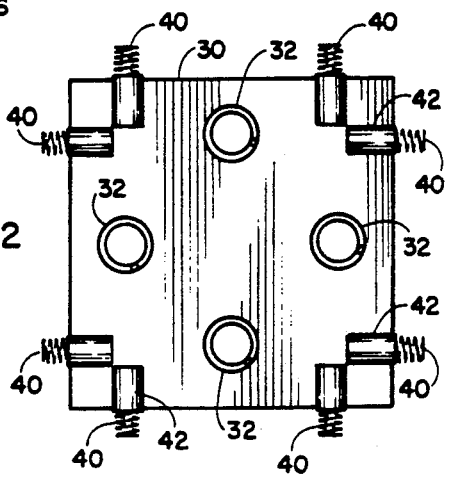
FIG. 3 is a detail horizontal section view taken on line 3—3 3 in FIG. 2.

As best seen in FIG. 3, a plurality of small outwardly extending compression springs 40 in tubular housings 42 secured to plate 30 will encounter and cushion contact between plate 30 and bottom frame 24 in the event of severe oscillations. With severe oscillations, or where longitudinal forces are produced in one direction due to earth slippage, springs 40 will tend to be impacted by frame 24 in one direction, moving plate 30 across surface 14 toward a wall 16. As the frame approaches a wall 16, it will contact a spring band 18 which will absorb energy and help prevent severe impact with a wall. Frames 24 preferably have a box section as shown to spread the load against spring bands 18 while spreading the vertical load over surface 14.

The use of base 10 is preferred for the reasons given above. However, where severe earthquakes are unlikely, base 30 could be fastened directly to a horizontal planar surface attached to the building sub-foundation, preventing horizontal movement of support 12 beyond the movement of box 19 relative to plate 30.

The number and size of base members 10 and support members 12 in a given case will depend upon the weight of the building to be supported and the extent of earthquakes anticipated. In general, fewer larger or more smaller support systems may be used as desired.

Figure 5:
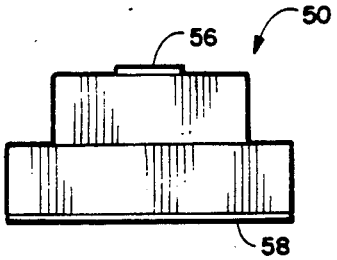
FIG. 5 is a detail plan view of the support member of the second embodiment.
Figure 4:
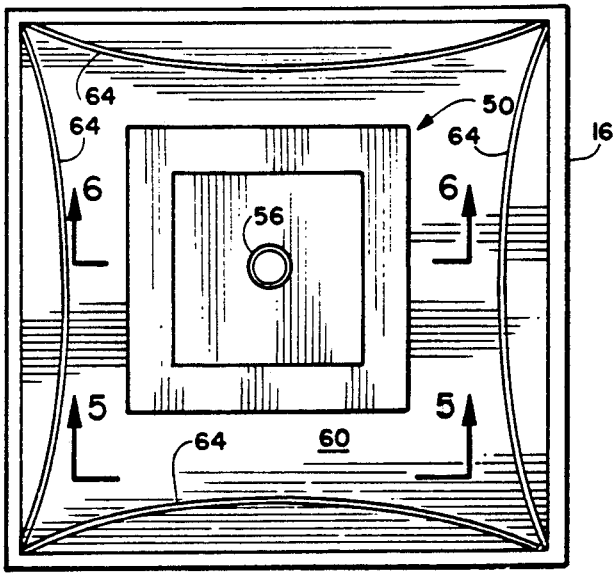
FIG. 4 is a plan view of a second embodiment of the support system of this invention.
Figure 6:
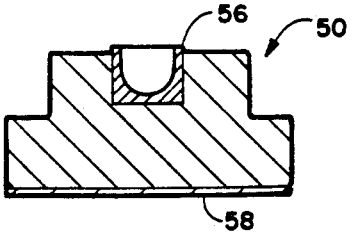
FIG. 6 is a vertical section view taken on line 6—6 in FIG. 4.

A second, somewhat simpler embodiment of my earthquake resistant system is shown in FIGS. 4–6. This embodiment may be preferred where earthquakes of lower intensity are expected or where it is preferred to use a large number of slightly less effective support systems rather than fewer of the somewhat more effective systems described above.

In this embodiment, a simple block support member 50 has a rounded socket 56 at the upper center to receive a downwardly extending rod or post, having a rounded lower end, on the building being supported. Block 50 may be formed from any suitable material such as metal, concrete or the like. Where block 50 is formed from a material other than metal, it is preferred that socket 56 be lined with metal, as shown and that a metal sheet 58 be fastened to the undersurface of block 50 to reduce friction against the underlying base. Preferably, there will be relatively low friction between sheet 58 and the underlying base. A friction reducing coating, such as a suitable lubricant such as graphite or Teflon fluorocarbon may be used.

A rectangular base 60, generally similar to that shown in FIGS. 1–3, having an upstanding rectangular wall 62 underlies support 50. During an earthquake, in response to earth oscillations or slippage, base 60 will move about relative to block 50 and the supported building. As the wall approaches block 50, spring bands 64, of the sort described above, are provided to resist and damp movement of wall 62 against block 50.

Figure 7:
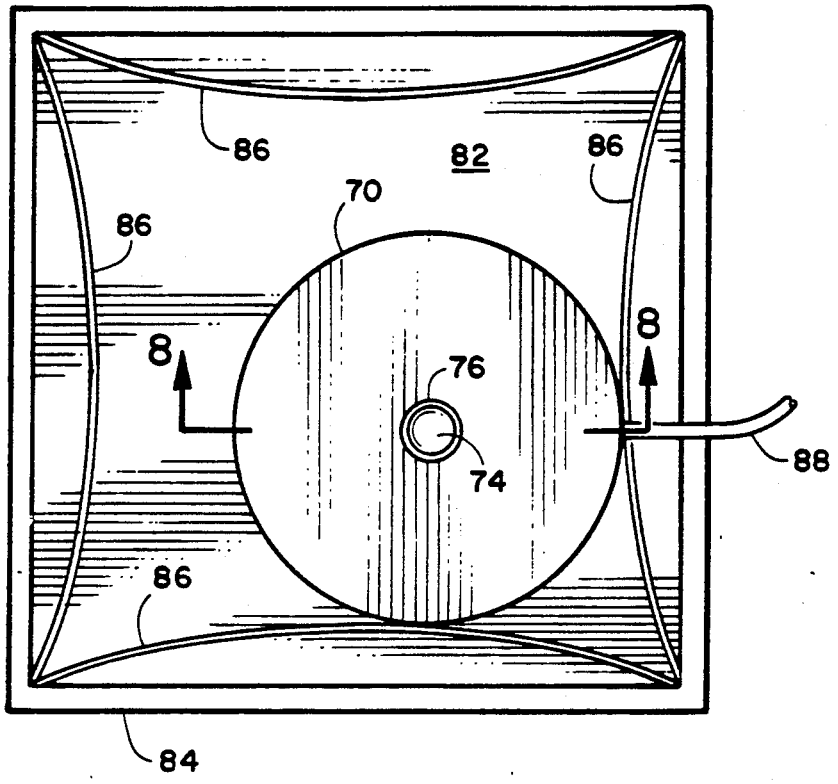
FIG. 7 is a detail plan view of the third embodiment of the support system of this invention.
Figure 8:
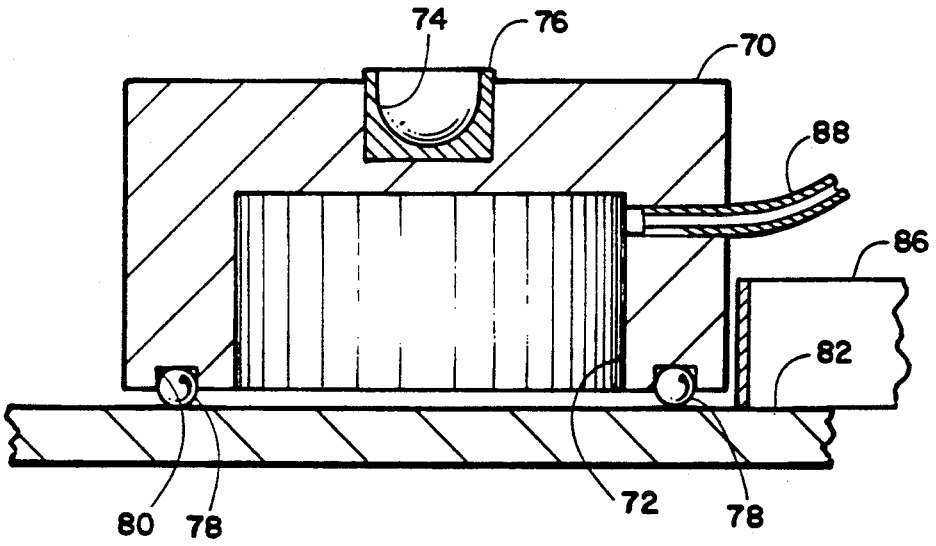
FIG. 8 is a vertical section view taken on line 8—8 in FIG. 7.

A third embodiment of my earthquake resistant building support system is illustrated in FIGS. 7–8. Here a generally cylindrical housing 70 having an internal cavity 72 open at one end is used as the support member. A socket 74 is provided at the center of the closed end to receive a downwardly extending rod or post from the building to be supported. Housing 70 may be formed from any suitable material, preferably a metal such as steel or aluminum. Where a relatively soft metal is used, a steel sleeve 76 is preferred as a lining for socket 74.

A resilient, somewhat compressible, rubber, plastic or the like O-ring 78 is pressed into a slot 80 in the lower surface of support housing 70 adjacent to cavity 72. O-ring 78 rests on a base member 82 or the sort described above, having walls 84 and a resilient band 84 along the walls to absorb shock and energy should the housing 70 move toward a wall 84 during an earthquake.

A tube 88 extends into a hole (not shown) through the wall of housing 70 into cavity 72. Air under pressure from a conventional compressor (not shown) or other suitable source is directed into cavity 72 through tube 88. The air pressure lifts or lightens housing and the supported building slightly, reducing the compression of O-ring 78 against surface 84, allowing the surface 84 to slip relative to support 70. Excessive air pressure will simply leak out past O-ring 78. Since ordinarily little air will leak, the compressor and any pressure accumulator will only operate occasionally.

Other applications, variations and ramifications of this invention will occur to those skilled in the art upon reading this disclosure. Those are intended to be included within the scope of this invention, as defined in the appended claims.

I claim:

1. An earthquake resistant building support system which comprises:

a base means adapted to be secured to the earth below a building;

a substantially horizontal planar upper surface on said base means;

an upstanding wall surrounding said base means;

building support means adapted for connection to and support of at least a portion of a building;

said support means adapted to rest on said base upper surface for sliding movement relative thereto:

said support means comprises a box frame having a closed top and an open bottom, said open bottom adapted to rest on said base upper surface, attachment means on said closed top for supporting connection to a building, a plate within said open bottom adapted to rest on said base upper surface, a plurality of first compression springs secured to said plate and extending therefrom toward said closed top, an upwardly opening socket secured to each of said first springs, a blot threaded through said closed top immediately above each of said sockets and adapted to enter said sockets, the bolts when threaded downwardly into said box adapted to compress said first springs resulting in a lifting force on said box, and a plurality of second compression springs secured to said plate with said springs extending outwardly substantially parallel to said plate toward portions of said box surrounding said open bottom and adjacent to said plate whereby horizontal and longitudinal earthquake forces can cause said base and said plate to move with the earth while said box remains substantially stable and where in the case of extreme earthquake forces said plate can slide relative to said base surface;

spring means along said base wall to absorb energy and prevent direct impact in the event that said relative sliding movement brings said wall and support means together.

2. The system according to claim 1 wherein said spring means comprises a plurality of bands of spring material having ends secured to said wall and bowed away from said wall.

3. The system according to claim wherein said wall is made up of substantially straight segments and each of said bands of spring material secured to said wall near the ends of a wall segment and extends across said segment.

4. The system according to claim 1 wherein said support means comprises:

a box frame having a closed top and an open bottom, said open bottom adapted to rest on said base upper surface;

attachment means on said closed top for supporting connection to a building;

a plate within said open bottom adapted to rest on said base upper surface;

a plurality of first compression springs secured to said plate and extending upwardly therefrom toward said closed top;

an upwardly opening socket secured to each of said first springs;

a bolt threaded through said closed top immediately above each of said sockets and adapted to enter said sockets;

said bolts when threaded downwardly into said box adapted to compress said first springs resulting in a lifting force on said box; and a plurality of second compression springs secured to said plate with said springs extending outwardly substantially parallel to said plate toward portions of said box surrounding said open bottom and adjacent to said plate;

whereby horizontal and longitudinal earthquake forces can cause said base and said plate to move with the earth while said box remains substantially stable and where in the case of extreme earthquake forces said plate can slide relative to said base surface.

5. The system according to claim 4 wherein said building attachment means comprises an upwardly opening socket substantially at the center of said closed top adapted to receive a downwardly extending post on said building.

6. The system according to claim 5 further including a flange along the edges of said open bottom adapted to contact said base upper surface.

7. The system according to claim 6 wherein said open box bottom is rectangular in shape, said plate is rectangular and each side of said plate includes two of said second compression springs extending outwardly of the plate edges near the corners of said plate.

8. An earthquake resistant building support system which comprises:

a box frame having a closed top and an open bottom adapted to rest on a substantially horizontal planar base;

attachment means on said closed top for supporting connection to a building;

a plate within said open bottom adapted to be secured to said base;

a plurality of first compression springs secured to said plate and extending upwardly therefrom toward said closed top;

an upwardly opening socket secured to each of said first springs;

a bolt threaded through said closed top immediately above each of said sockets and adapted to enter said sockets;

said bolts when threaded downwardly into said box adapted to compress said first springs resulting in a lifting force on said box; and a plurality of second compression springs secured to said plate with said springs extending outwardly substantially parallel to said plate toward portions of said box surrounding said open bottom and adjacent to said plate;

whereby horizontal and longitudinal earthquake forces can cause said plate to move with said base and earth while said box and building remain substantially stable.

9. The system according to claim 8 wherein said building attachment means comprises an upwardly opening socket substantially at the center of said closed top adapted to receive a downwardly extending post on said building.

10. The system according to claim 9 further including a flange along the edges of said open bottom adapted to contact said base surface.

11. The system according to claim 10 wherein said open box bottom is rectangular in shape, said plate is rectangular and each side of said plate includes two of said second compression springs extending outwardly of the plate edges near the corners of said plate.

* * * * *